US006317102B1

(12) United States Patent
Stambeck

(10) Patent No.: US 6,317,102 B1
(45) Date of Patent: Nov. 13, 2001

(54) METHOD AND TOOL FOR MANUFACTURING AN ANTENNA UNIT, AND AN ANTENNA UNIT

(75) Inventor: Peter Stambeck, Björklinge (SE)

(73) Assignee: Munkplast International AB, Uppsala (SE)

( * ) Notice: Subject to any disclaimer, the term of this patent is extended or adjusted under 35 U.S.C. 154(b) by 0 days.

(21) Appl. No.: 09/623,463

(22) PCT Filed: Mar. 12, 1999

(86) PCT No.: PCT/SE99/00379

§ 371 Date: Sep. 12, 2000

§ 102(e) Date: Sep. 12, 2000

(87) PCT Pub. No.: WO99/46830

PCT Pub. Date: Sep. 16, 1999

(30) Foreign Application Priority Data

Mar. 12, 1998 (SE) ..... 9800809
Jan. 3, 1999 (SE) ..... 9900732

(51) Int. Cl.[7] ..... H01Q 9/30; H01P 11/00
(52) U.S. Cl. ..... 343/900; 343/702; 29/600
(58) Field of Search ..... 343/900, 901, 343/903, 715, 702; 29/600; H01Q 9/30; H01P 11/00

(56) References Cited

U.S. PATENT DOCUMENTS 4,725,395 2/1988 Gasparaitis ..... 264/250
5,341,149 8/1994 Valimaa et al. ..... 343/895
5,353,493 * 10/1994 Harada et al. ..... 29/600
5,836,072 * 11/1998 Sullivan et al. ..... 29/600

FOREIGN PATENT DOCUMENTS 2305298A 4/1997 (GB) .

OTHER PUBLICATIONS

Patent Abstracts of Japan, abstract of JP 9–174596 A (Murata Mfg. Co. Ltd.), Jul. 8, 1997.

* cited by examiner

*Primary Examiner*—Hoanganh Le
(74) *Attorney, Agent, or Firm*—Jacobson Holman, PLLC

(57) ABSTRACT

A method for manufacturing an antenna unit, including a resilient, metallic core (10), which is in the form of a wire, and an injected, insulating jacket at least partially enclosing the core, wherein use is made of an injection moulding tool, which is split in a parting plane (D), containing the longitudinal, central axis of the core. The insulating jacket is injection moulded in two steps. The core is in a first step provided with a first jacket portion (15), while the remaining part of the core is supported in a first mould cavity portion (11B), which is adapted to the shape of the core. At least a part of the injection moulding tool and the core with the injected first jacket portion are displaced in relation to each other. In a second step, the still bare part of the core is provided with a second jacket portion, supplementary to the first-mentioned jacket portion, while the core (10) with the injected first jacket portion (15) is supported inside a second mould cavity portion (19), which is adapted to the shape of the first jacket portion.

17 Claims, 4 Drawing Sheets

MOVEABLE HALF (MH)

METHOD AND TOOL FOR MANUFACTURING AN ANTENNA UNIT, AND AN ANTENNA UNIT

The present invention relates to a method and a tool for manufacturing an antenna unit, in particular an antenna unit for mobile phones and similar. The invention also relates to an antenna unit manufactured according to this method.

Antenna units for mobile phones normally have a central, preferably resilient, metallic core, for example in the form of a wire or tubular core, usually with a circular cross-section, and a jacket enclosing the resilient core, consisting of a suitable thermoplastic material, preferably of a kind being particularly fluid, the jacket mainly serving to improve the aesthetic impression of the antenna unit. The design of the upper end of the antenna unit and its base may vary from one manufacturer to another.

Hitherto, attempts have frequently been made to centre the metallic core in the best possible way in a tubular jacket material, which either is manufactured beforehand or is being manufactured, for example by injection moulding, when the resilient core is introduced into the jacket. These operations are quite cumbersome and usually lead to considerable centering difficulties. The metallic, resilient core may therefore occupy exceedingly odd positions and bending shapes in the enclosing jacket.

The purpose of the present invention is to create a method and a tool to be used when manufacturing an antenna unit, which method may be performed easily and rapidly, and which ensures that the metallic core occupies a well defined and uniformly centered position in the manufactured antenna unit. The method concerns the manufacture of an antenna unit, including a metallic core, which is tubular or in the form of a wire and which is preferably resilient, and a jacket which encloses the core partially or fully, and which is made of an injectable material. A tool is used for injection moulding, said tool being split in a parting plane comprising the longitudinal, central axis through the core. The method is characterised essentially in that the isolating jacket is injected in at least two steps, wherein the core in a first step is provided with a first jacket portion substantially shaped like a tubular semi-cylinder while the remaining part of the core is supported in a first mould cavity portion adapted to the shape of the core, whereupon at least a part of the injection moulding tool and the core with the injected first jacket portion are displaced in relation to each other, such that the core with the injected first jacket portion is supported in a mould cavity portion shaped for this purpose. Thereafter, the still bare portion of the core, in a second step, is provided with a second jacket portion, being supplementary to the first-mentioned jacket portion and being shaped substantially like a tubular semi-cylinder.

According to the invention, it is suitable that the antenna unit, preferably through combined radial and axial injection, such that a certain rotation and turbulence occurs in the injected material, is provided with a knob, situated in a separate mould cavity around the upper end of the core and in intimate contact with at least the first injected jacket portion. It should also be possible, after minor modification of the tool, to manufacture so called dual-antenna units, i.e. antenna units containing two parallel antenna cores, situated side by side at some distance from each other in said parting plane of the tool. Preferably one is somewhat shorter than the other so as to be adapted to the prevailing frequency intervals.

It should also be possible, after corresponding modifications of the tool, to manufacture also so called telescopic aerials in a similar manner.

Further suitable features are stated in claims 2 through 17.

The invention will be described further below with reference to the appended drawings illustrating two embodiments of a tool for manufacturing an antenna unit according to the invention.

Figure 1:
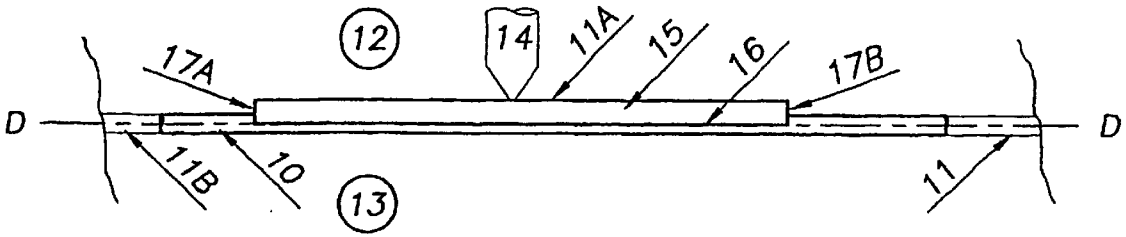
FIGS. 1–3 illustrate a first, a second and a third step, respectively, during the manufacturing of an antenna unit according to a first embodiment.
Figure 2:
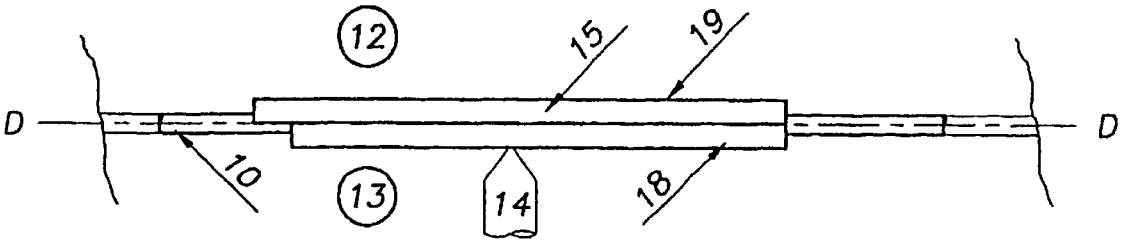
Figure 3:
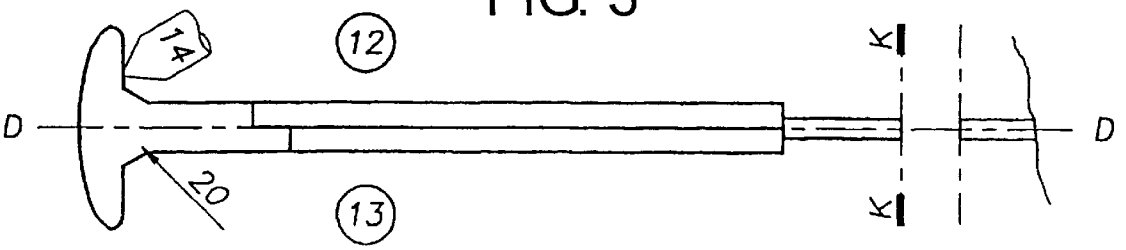

For a full understanding of the first embodiment according to FIGS. 1–3, these figures should be placed side by side, from left to right on the drawing, with the parts of the antenna core aligned with each other.

According to FIG. 1, a core wire 10 of a suitable, preferably resilient material, for example a nickel-titanium alloy, and with an outer diameter of, e.g., 0.9 mm, is introduced into a first mould cavity, generally referred to as 11, between two tool halves 12 and 13. This first mould cavity 11 is designed in such a way that one can provide the core wire 10, through injection of a suitable plastic material, into a first portion 11*a* of the tool part 12 through channels 14, with a first jacket portion 15 shaped like a tubular semi-cylinder with a substantially uniform wall thickness, lateral surfaces 16 parallel with the parting plane D of the tool, and end wall surfaces 17A, 17B transverse to the axis of the core wire 10. Now, the core wire rests with one half thereof in a groove 11B in the lower tool half 13.

In accordance with FIG. 2, the core wire is thereafter moved axially a distance corresponding to at least the length of the first jacket portion 15, whereupon the core wire, through injection of a plastic material, is provided with a second jacket portion 18, whereas the first jacket portion 15 with the enclosed core wire is resting in a mould cavity 19, adapted to the first jacket portion 15 in the upper mould half 12. One realises that the core portions 15 and 19 are substantially identical in shape. However, it may be preferable that, as illustrated in FIG. 2, the second injected jacket portion, through corresponding shaping of the mould cavity intended for this jacket portion, is given a shorter axial length than the first injected jacket portion.

In the first injection step, the position of the unit is controlled in that one half of the core wire is guided in its groove, and during the second injection step, the position of the unit is controlled in that the first jacket portion with enclosed core wire is guided in a groove designed for this purpose in the upper tool part 12.

If desired one may, as indicated in FIG. 3, as a last step, provide the antenna unit with a properly shaped protective knob, preferably during injection of the plastic in a combined axial and radial direction, such that one achieves, for the best possible injection, a favourable rotational movement and turbulence of the plastic material.

A person skilled in the art realises that, at a suitable instant, preferably after the completion of the second step of the core injection, in connection with the closing of the tool for injection of the illustrated knob, the core wire is cut off, for example in the plane K illustrated in FIG. 3.

Figure 4:
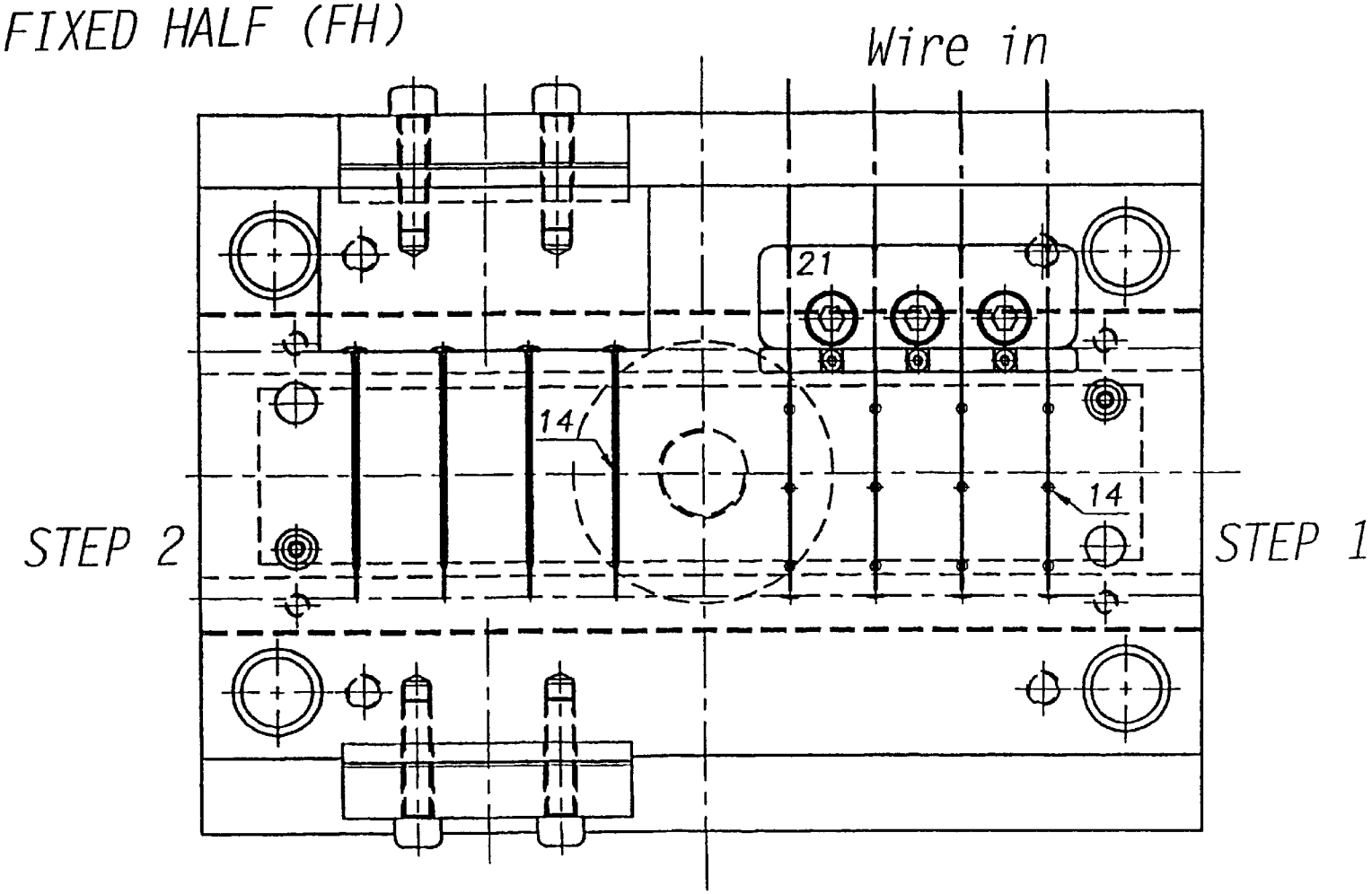
FIGS. 4–6 illustrate a second embodiment wherein a tool is used with a fixed and a rotary part.
Figure 5:
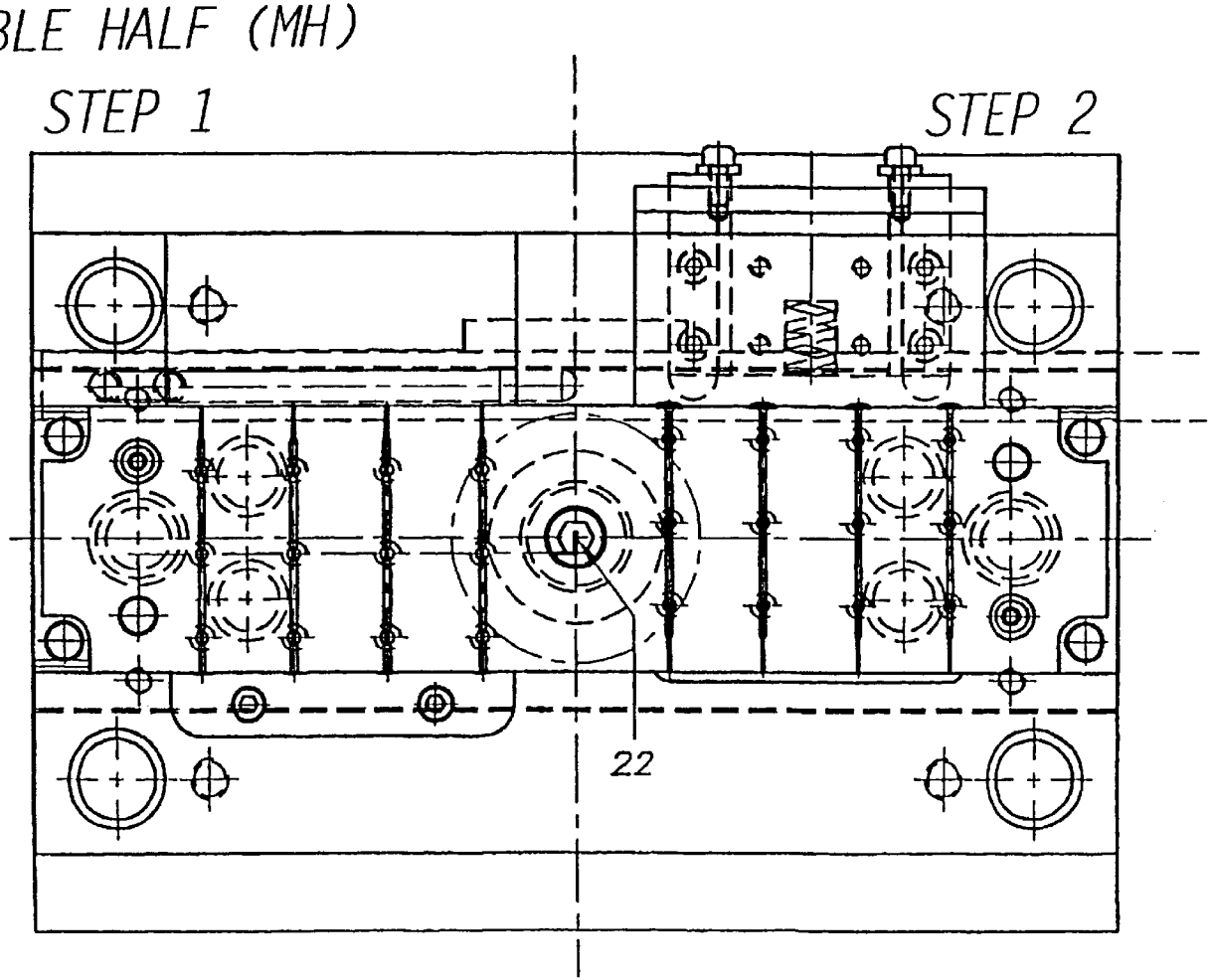
Figure 6B:
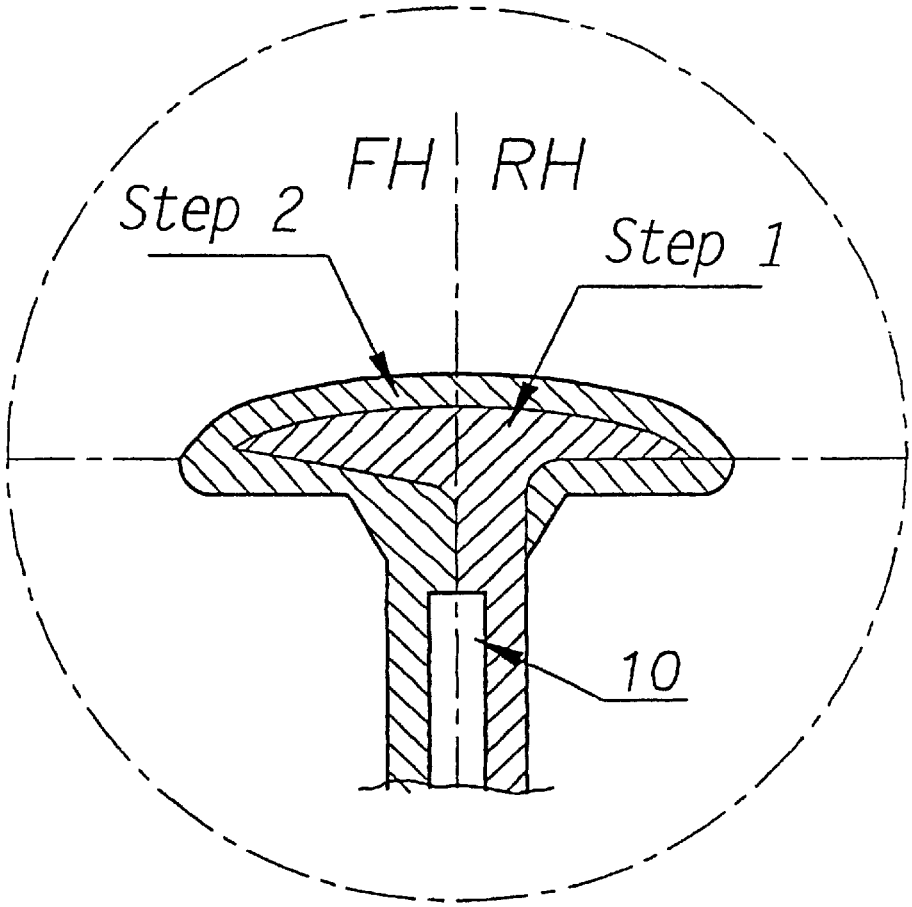
Figure 6A:
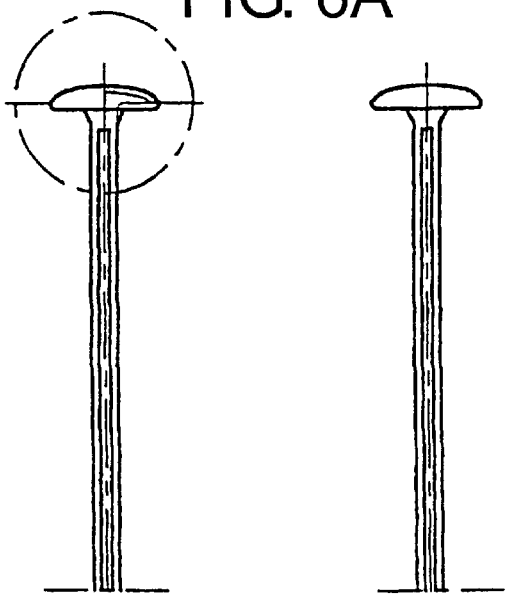

In the embodiment according to FIGS. 4–6, a wire blank is inserted in a fixed tool part (FIG. 4) and is cut off by means of a device 21. Half of the wire blank is covered by injection of plastic material, preferably while retaining supporting tabs. Thereupon, a movable tool part (FIG. 5) is rotated half a turn around an axis 21, whereupon the other half of the cut wire blank is covered by injection material until a complete product is achieved. Concurrently, newly inserted wire blanks are half covered by injection material. After each injection, fully manufactured antenna units are output from the tool.

As illustrated in FIG. 4, each time four wires are inserted into the fixed part of the tool, whereupon the tool is closed and the wires are cut off. Thereafter, half the surface of the wire and a part of the core knob are covered by injection material.

The tool is now opened with its movable part, whereupon the semi-finished details are lifted. Thereafter, the movable tool part is rotated and brings with it its semi-finished details to the opposite part (the left part of FIG. 4) of the fixed tool part, and concurrently new wire is inserted into the fixed tool part (the right part of FIG. 4). Thereafter, the tool is closed and the semi-finished parts are kept in their mould cavities which now constitute mould cavities for a safe fixation of the jacket portions with accompanying cores. Thereafter, the second jacket portion and the remaining part of the knob are covered by injection material, as illustrated in FIG. 6.

What is claimed is:

1. A method for manufacturing antenna units including a metallic core, which is tubular or in the form of a wire, and a jacket composed of an injectable, insulating material, at least partially enclosing the core, wherein use is made of an injection moulding tool, which is split in a parting plane containing the longitudinal, central axis of the core characterised in that the insulating jacket is injection moulded in at least two steps, wherein the core, in a first step, is provided with a first jacket portion substantially shaped as half a tubular cylinder, while the remaining parts of the core are supported inside a first mould cavity portion, adapted to the shape of the core, whereupon at least a part of the injection moulding tool and the core with the injected first jacket portion are displaced in relation to the other, such that the core with the injected first jacket portion is supported inside a second mould cavity portion, which is adapted to this purpose, whereupon the still bare part of the core, in a second step, is provided with a second jacket portion, supplementary to the first-mentioned jacket portion and being shaped substantially as half a tubular cylinder.

2. The method according to claim 1, characterised in that, after said first step, the core (10) with the injected first jacket portion (15), is fed forward axially a distance corresponding at least to the length of the first jacket portion.

3. The method according to claim 1, characterised by that said first jacket portion is given a substantially even wall thickness, with lateral sides (16) situated in said parting plane and end walls (17A, 17B) positioned counter to the jacket axis and, that said second jacket portion is given a substantially even wall thickness, lateral sides situated in said parting plane, and end walls positioned counter to the jacket axis.

4. The method according to claim 1 characterised in that the second injected jacket portion (18), by a corresponding design of the mould cavity intended for this jacket portion, is given a smaller axial length than the jacket portion injected first.

5. The method according to claim 1 characterised in that the antenna unit, during a third injection step, is provided with a knob (20), situated in a mould cavity around the upper end of the core and in intimate contact with at least the end of the core and the first injected jacket portion.

6. The method according to claim 5 characterised in that the injection during the third step is performed through combined radial and axial injection into said mould cavity, in such a way that a certain turbulence and rotation of the injected material occurs.

7. The method according to claim 1 characterised in that the antenna unit during the first and/or the second injection steps is provided with a knob (20).

8. The method according to claim 1, characterised in that, after said first step, a movable part of the tool is rotated a half turn in relation to a fixed part of the tool, wherein the core with its injected first jacket portion is brought from said first mould cavity, situated in the first tool part, to a mould cavity corresponding to said second jacket portion, also situated in the fixed tool part, and wherein the mould cavity, which is used for injection of the first jacket portion, is situated in the movable tool part and constitutes during said second step, said second mould cavity.

9. The method according to claim 8, characterised in that said first and second steps are performed concurrently in two opposite parts of the tool.

10. The method according to claim 8, characterised in that several antenna units are manufactured concurrently in said both opposite parts of the tool.

11. The method according to any one of claim 8, characterised in that, after each turn of the moveable tool part and expulsion of a respective ready-made antenna unit, one or several wire blanks, intended to constitute said core or cores, are inserted into the fixed tool part.

12. Tool for manufacturing an antenna unit in accordance with the method defined in claim 1, wherein the antenna unit contains a metallic core, which is tubular or in the form of a wire, and a jacket composed of an injectable, insulating material, at least partially covering the core, wherein use is made of an injection moulding tool, which is split in a parting plane containing the longitudinal, central axis of the core, characterised in that the tool is provided with two separate mould cavities, namely a first mould cavity (11A), in which the core during a first step is provided through injection with a first jacket portion (15) shaped as half a tubular cylinder, while the remaining part of the core is supported in a mould cavity portion (11B) adapted to the shape of the core, and a second mould cavity, situated at a distance from the first mould cavity, in which the still bare part of the core, correspondingly, in a second step is supplied with a second jacket portion, supplementary to the first mentioned jacket portion (18), shaped as half a tubular cylinder, while the core with the injected, first jacket portion is supported in a second mould cavity portion (19), shaped for this purpose.

13. Tool according to claim 12, characterised in that the tool has a separate mould cavity for receiving one end of the core for forming a knob (20) onto the core.

14. Tool according to claim 13, characterised in that said separate mould cavity during a third injection step is in intimate contact with at least the outer end of the core and said jacket portion.

15. Tool according to claim 12, characterised in that a separate mould cavity, for forming of at least a part of a knob on one end of the core, is connected to said first mould cavity.

16. Tool according to claim 12, characterised in that the tool has at least one more mould cavity, extending in parallel to the other mould cavities, at some distance from these and in the same mould parting plane, for injection of a jacket onto an additional core, extending in parallel to the first mentioned core, for forming a so called dual antenna.

17. Antenna unit manufactured according to a method as defined in claim 1.

* * * * *